US005275718A

United States Patent [19]

Copeland et al.

[11] Patent Number: 5,275,718

[45] Date of Patent: Jan. 4, 1994

[54] LUBRICANT BASE OIL PROCESSING

[75] Inventors: C. Monroe Copeland, Crosby; Frank McKay, Highlands; John M. Noreyko, Seabrook; Michael Rombs, Deer Park; Darrell Sutherland, Pasadena, all of Tex.

[73] Assignee: Lyondell Petrochemical Company, Houston, Tex.

[21] Appl. No.: 688,723

[22] Filed: Apr. 19, 1991

[51] Int. Cl.[5] ..... C10G 11/00; C10G 45/00

[52] U.S. Cl. ..... 208/012; 208/144; 208/145; 208/143

[58] Field of Search ..... 208/12, 144

[56] References Cited

U.S. PATENT DOCUMENTS

| | | | |
|---|---|---|---|
| 3,189,540 | 6/1965 | Kozolowski et al. | 208/12 |
| 3,281,352 | 10/1966 | Schuman | 208/12 |
| 3,904,513 | 9/1975 | Fischer et al. | 208/264 |
| 3,915,841 | 10/1975 | Murphy et al. | 208/89 |
| 3,979,279 | 9/1976 | Yan | 208/264 |
| 4,031,016 | 6/1977 | Berger et al. | 252/50 |
| 4,062,762 | 12/1977 | Howard et al. | 208/211 |
| 4,157,294 | 6/1979 | Iwao et al. | 208/264 |
| 4,251,347 | 2/1981 | Rausch et al. | 208/57 |
| 4,601,996 | 7/1986 | Miller | 502/242 |
| 4,673,487 | 6/1987 | Miller | 208/58 |
| 4,775,280 | 7/1988 | Hudson et al. | 208/57 |
| 4,897,175 | 1/1990 | Bricker | 208/145 |
| 4,992,157 | 2/1991 | Bricker et al. | 208/12 |

OTHER PUBLICATIONS

"Lubricant Base Oil Processing", Avilino Sequeira, *Lubrication*, vol. 75, No. 1 (1989).

*Primary Examiner*—Helane Myers

*Attorney, Agent, or Firm*—Arnold, White & Durkee

[57] ABSTRACT

A hydrofinishing process for improving the color, thermal and oxidative stability of a base stock for lubricating oil wherein the lubricating oil stock is contacted with hydrogen in the presence of a nickel-molybdenum catalyst, at a pressure in the range of 400 psi to 3000 psi, at a weight hourly space velocity in the range of 0.25–4.5 and at a temperature in the range of 550° F. to 750° F.

16 Claims, No Drawings

LUBRICANT BASE OIL PROCESSING

BACKGROUND OF THE INVENTION

I. Field of the Invention

This invention relates to an improved method of preparing base stocks for lubricating oil with improved color, thermal and oxidative stability. More particularly, it relates to an improved method of preparing base stocks for lubricating oil with improved color, thermal and oxidative stability by varying the temperatures and pressures of the hydrofinishing process.

II. Background of the Invention

It is well-known that lubricants are susceptible to deterioration by oxidation. Lubricants can be attacked by oxygen or air at high temperatures to form heavy dark viscous sludges, varnish and resins. Such deterioration reduces a lubricant's effectiveness to perform its required task. Accompanying the deterioration of lubricants by oxidation is the resultant corrosion of the metal surfaces for which such lubricants were designed to protect. Acids develop from the sludges and resins which are corrosive enough to destroy most metals. In addition, increased demands on lubricants brought about by newer and larger engines and other rotating or moving equipment, operating at increasing temperatures, pressures and speeds dictate the need for improvement in a lubricant's resistance to deterioration by oxidation. A lubricant's color, thermal and oxidative stability reflect the lubricant's resistance to oxidation.

This invention relates to an improved method for preparing base stocks for lubricating oil using a hydrogen treatment technique. The three most common hydrogen treatment techniques associated with lubricating oil production, as described in U.S. Pat. No. 3,915,841 to Murphy, Jr., et al., are hydrocracking, hydrotreating and hydrofinishing.

Hydrocracking is an extremely severe hydrogen treatment, usually conducted at comparatively high temperatures requiring employment of a catalyst having substantial cracking activity, e.g., an activity index (A.I.) greater than 40 and generally greater than 60. This type of process is conducted to effect extensive and somewhat random severing of carbon-to-carbon bonds resulting in an substantial overall reduction in molecular weight and boiling point of the treated material. Thus, for example, hydrocracking processes are generally employed to effect an extremely high conversion, e.g., 90% by volume, to materials boiling below the boiling range of the feedstock or below a designated boiling point. Usually a hydrocracking process is employed to produce a product boiling predominantly, if not completely, below about 600° F. to 650° F. Most frequently, this type of process is employed to convert higher boiling hydrocarbons with products boiling in the furnace oil and naphtha range. When applied in connection with lubricating oils, hydrocracking processes produce only a minor quantity of materials boiling in the lubricating oil range, i.e., 625° F. to 650° F., to the extent, at times, the production of a lubricating oil is merely incidental to the production of naphtha and furnace oil.

As distinguished from hydrocracking and hydrofinishing, hydrotreating is a processing technique significantly more severe than hydrofinishing although substantially less severe than hydrocracking. The catalyst required in a hydrotreating process must possess cracking activity and generally possess a particular type of activity termed "ring scission activity." A hydrotreating process effects a substantial molecular rearrangement as compared to the hydrofinishing but does not effect the extensive and somewhat random breakdown in molecules effected in hydrocracking.

On the other end of the spectrum, hydrofinishing is a mild hydrogen treatment process employing a catalyst having substantially no cracking activity. This fixed-bed catalytic hydrogenation process effects removal of contaminants such as color forming bodies and a reduction of minor quantities of sulfur, oxygen, and nitrogen compounds. Unlike hydrocracking or hydrotreating, hydrofinishing does not saturate aromatics, nor break carbon-carbon bonds. As a general rule, hydrofinishing is employed in lieu of older techniques of acid and clay contacting for the purpose of improving color, odor, thermal and oxidative stability of lubricating oil base stocks. The operating conditions of the hydrofinishing process are a function of the feedstock composition, catalyst type and product specifications.

Conventional hydrofinishing temperatures and pressures have nominally been in the 450° F. to 500° F. and 400 psi to 700 psi range. However, conventional hydrofinishing conditions have not produced lubricating oil base stocks with satisfactory color, thermal and oxidative stability needed for operating under conditions of steadily increasing temperatures and pressures. Accordingly, this invention provides a process whereby the color, thermal and oxidative stability of lubricating oil stocks is improved. Surprisingly, these improvements were obtained by increasing the temperature of the hydrofinishing process.

SUMMARY OF THE INVENTION

In accordance with the present invention, a method for preparing base stocks for lubricating oil with improved color, thermal and oxidative stability is provided. More particularly, the present invention provides methods for preparing base stocks for lubricating oil with improved color, thermal and oxidative stability by increasing the processing temperature of the hydrofinishing process.

The method consists of contacting a lubricating base stock with a nickel-molybdenum catalyst in the presence of hydrogen, at a pressure ranging from about 400psi to 3000 psi, space velocities of about 0.25 to 4.5 W.H.S.V. and at a temperature of about 550° F. to 750° F.

DESCRIPTION OF SPECIFIC EMBODIMENTS

The lubricating oil stock which may be treated in accordance with the present invention may generally be any mineral oil boiling above about 600° F. More particularly, naphthene pale oils and solvent neutral oils can be treated by this process. The lubricating oil stocks treated by this invention include oils produced by processes including fractionation, solvent extraction and dewaxing, or combinations of these processes. Oil stock having a sulfur content up to 2 weight percent may be treated in accordance herewith to achieve a stabilized lubricating oil stock. In addition, base oils of all viscosity ranges can be treated by the process of the present invention. Specific embodiments of the lubricating oil stock used by this invention include those obtained by fractionation via vacuum distillation of West Texas, Brent, and Olmeca crude oils, or their equivalents or mixtures thereof.

The catalyst material used in one embodiment of the present invention is nickelmolybdenum. Other hydrofinishing catalysts may be used with the process of this invention. Fixed beds of the catalyst material are arranged within the reaction vessel or tower. Catalysts are normally received in the oxide form and are sulfided prior to placement on the fixed beds. Metal poisoning of the catalysts is not a problem because most of the metals in the lubricating oil feedstock are removed during refining processes. The catalyst have long service lives and may be regenerated using a controlled oxygen burn. The oil feedstock is mixed with hydrogen gas as it enters the reaction vessel or tower. Impurities such as sulphur and nitrogen react with the hydrogen and are removed as off gas. The increased temperature of this process also increases saturation thereby decreasing the olefinic compound content of the lubricating oil stock.

The color, thermal and oxidative stability of lube base stocks can be effectively controlled by the hydrofinishing temperatures and pressures of the process. Hydrofinishing temperatures and pressures have nominally been in the 450° F. to 500° F. and 400 psi to 700 psi range. By increasing the temperature to 550° to 750° F. range while maintaining the same pressures a more stable base oil, exhibiting better color, thermal and oxidative properties is produced. The improved lube base stocks can also be produced at hydrofinishing pressures up to 3000 psi if the hydrofinishing temperature is within the 550° F. to 750° F. range. By increasing the temperature, the process shows improvement in base oil volatility and lowers the sulfur, nitrogen and olefinic content of the lubricating oil stock.

The operating parameters in the present process are critical to achieving the improved lubricating oil stock. The reaction vessel or tower must be pressurized with hydrogen at a pressure within the range of about 400 psi to 3000 psi. Process temperature must be maintained in the range of from about 550° F. to 750° F., with a preferred temperature range being from about 550° F. to 650° F. The weight hourly space velocity (W.H.S.V.) must be maintained in the range of about 0.25–4.5 lbs. feed per hr./lbs. catalyst. The process and conditions utilized will be dependent upon the feedstock and type and condition of the catalyst used in the hydrofinishing process. Generally, the operating temperatures are increased as the catalyst ages.

Base oils produced under these conditions have marketable advantages over conventionally processed oils in that improved color, thermal and oxidative stability allow the oil to be used in high temperature processes without the addition of costly additives or stabilizers. The finished lube base stocks exhibit improved volatility because of higher temperature treatment and the corresponding removal of light ends.

In order to more fully illustrate the process of the present invention, the following example, which in no sense limits the invention, is presented. The test procedure used in evaluation of the product color stability from the present process is to heat the product for 72 hours at 300° F. and then perform the standard test designated ASTM: D-1500-1 (color test) (1988). Thermal stability is evaluated by visually observing whether sludge or precipitate forms after heating the lubricant stock for 72 hours at 300° F.

The lubricating oil stock of the following example was obtained by vacuum distillation of crude oil into heavy, medium and light lube distillates. The distillate lube stock was further refined by solvent extraction using N-methyl-2-pyrrolidone to remove undesirable constituents such as aromatics. The oil stock was then dewaxed by a solvent dewaxing process using a solvent mixture of methyl ethyl ketone (MEK) and toluene. The feedstock utilized in the example was West Texas Intermediate.

The catalyst used in the following example is a nickel-molybdenum catalyst on alumina obtained from Criterion Catalysts Company. The $NiMo/Al_2O_3$ catalyst used is more particularly described by the following properties:

| | |
|---|---|
| Chemical composition wt % dry basis | |
| Molybdenum ($MoO_3$) | 17.5 |
| Nickel (NiO) | 3.2 |
| Sodium ($Na_2O$) | 0.03 |
| Iron (Fe) | 0.03 |
| Sulfate ($SO_4$) | 0.4 |
| Alumina ($Al_2O_3$) | 78.8 |
| Physical Properties | |
| Size, pressure drop equivalent, inches (mm) | 1/16 (1.6) |
| Average diameter, inches (mm) | 0.05 (1.3) |
| Average length, inches (mm) | 0.16 (4.1) |
| Poured bulk density, $lb/ft^3$ (kg/l) | 44 (0.70) |
| Compacted bulk density, $lb/ft^3$ (kg/l) | 49 (0.78) |
| Crush strength, lb/mm (kg/mm) | 4.5 (2.0) |
| Surface area, $m^2/g$ | 170 |
| $H_2O$ pore volume, cc/g | 0.50 |

EXAMPLE

The lubricating oil stock used in this example has the following properties:

| | |
|---|---|
| Emulsion (D1401) @ 130° F. Max. | 40-37-3 (30) |
| Flash Point, °F. (°C.) (D 92), Min. | 375 (191) |
| Gravity, °API (D287) | 30–36 |
| Sulfur, % | 0.05 |
| Pour Point, °F. (°C.) (D 97) Max. | 10 (−12) |
| Viscosity, cSt (D445) | |
| @ 100° F. | 20.5–22.8 |
| @ 40° C. | 18.9–21.0 |
| Viscosity, SUS (D2161) | |
| @ 100° F. | 100–110 |
| Viscosity Index (D2270) Min. | 95 |
| Water | None |
| Acid No. (D974) | 0.01 |
| Aniline, °F. (°C.) (D611) | 216 (102) |

The untreated lubricating oil stock sample in this example was hydrofinished by contacting the oil stock with the nickel-molybdenum catalyst in the presence of hydrogen at a pressure of 480 psi and a temperature of 480° F. with a W.H.S.V. of 1.6. Samples 2–8 from the same feedstock as the first sample, were hydrofinished by contacting the oil stock with the same nickel-molybdenum catalyst in the presence of hydrogen at the same pressure conditions (480 psi) and with a W.H.S.V. of 1.6 but at temperatures from 550° F. to 675° F. As can be readily seen below, the lubricating oil stock samples treated at the elevated temperatures exhibited improved color. The treatment process of the present invention improved the 72 hour color of the lubricating oil stock from <4.5 to <2.5 in all but one sample. Applicant is unable to explain the results of sample 6, however, applicant believes the results to be a fluke. The thermal stability of the lubricating oil stock was also improved by the present invention as indicated by the lack of precipitate, or sludge, in the samples treated at 550° F. to 600° F. and 650° F.

| Oil Sample No. | Temp | Starting Color | ASTM Color @ 300° F. 12 Hr Color | 24 Hr Color | 36 Hr Color | 48 Hr Color | 60 Hr Color | 72 Hr Color | 72 Hr Precipitate |
|---|---|---|---|---|---|---|---|---|---|
| Sample 1 | 480° F. | <0.5 | <0.5 | <0.5 | <1.0 | <1.5 | <2.0 | <4.5 | Yes |
| Sample 2 | 550° F. 1st run | <0.5 | <0.5 | <0.5 | <0.5 | <0.5 | <1.0 | <2.0 | No |
| Sample 3 | 550° F. 2nd run | <0.5 | <0.5 | <0.5 | <0.5 | <0.5 | <1.0 | <2.0 | No |
| Sample 4 | 575° F. | <0.5 | <0.5 | <0.5 | <0.5 | <1.0 | <1.0 | <2.0 | No |
| Sample 5 | 600° F. | <0.5 | <0.5 | <0.5 | <1.0 | <1.0 | <1.0 | <2.5 | No |
| Sample 6 | 625° F. | <0.5 | <0.5 | <0.5 | <2.0 | <2.5 | <3.0 | <4.0 | Yes |
| Sample 7 | 650° F. | <0.5 | <0.5 | <0.5 | <1.0 | <1.0 | <1.5 | <2.0 | No |
| Sample 8 | 675° F. | <0.5 | <0.5 | <0.5 | <1.5 | <1.5 | <2.0 | <2.0 | Yes |

What is claimed is:

1. A single stage catalytic method of improving the color stability of a lubricant base stock consisting essentially of solvent neutral oil, the method comprising:

contacting the solvent neutral oil lubricating base stock with a hydrofinishing catalyst comprising nickel and molybdenum in the presence of essentially pure hydrogen, at a pressure ranging from about 400 psi to about 700 psi, at a weight hourly space velocity ranging from about 0.25–4.5 and at a temperature ranging from about 550° F. to about 750° F. for a time sufficient to yield an improved lubricant base stock, and collecting the improved lubricant base stock, which improved lubricant base stock exhibits as ASTM D-1500 color of about 2.5 or less after heating for 72 hours at 300° F.

2. The method of claim 1 wherein the sulfur content of said lubricating base stock is about 0.01 to 2.0 weight percent.

3. The method of claim 1 wherein said lubricating base stock comprises at least a substantial part of one obtained by fractionation of crude oil identified as West Texas, Brent or Olmeca.

4. The method of claim 1 wherein said catalyst is comprised of nickel and molybdenum on alumina.

5. A single stage catalytic method of improving the thermal stability of a lubricant base stock consisting essentially of solvent neutral oil, the method comprising:

contacting the solvent neutral oil lubricating base stock with a hydrofinishing catalyst comprising nickel and molybdenum in the presence of essentially pure hydrogen, at a pressure ranging from about 400 psi to about 700 psi, at a weight hourly space velocity ranging from about 0.25–4.5 and at a temperature ranging from about 550° F. to about 650° F. for a time sufficient to yield an improved lubricant base stock, which improved lubricant base stock exhibits no observable precipitate after heating for 72 hours at 300° F.

6. The method of claim 5 wherein the sulfur content of said lubricating base stock is about 0.01 to 2.0 weight percent.

7. The method of claim 5 wherein said lubricating base stock comprises at least a substantial part of one obtained by fractionation of crude oil identified as West Texas, Brent or Olmeca.

8. The method of claim 5 wherein said catalyst is comprised of nickel and molybdenum on alumina.

9. A single stage catalytic method of improving the color stability of a lubricant base stock consisting essentially of solvent neutral oil, the method comprising:

contacting the solvent neutral oil lubricating base stock with a hydrofinishing catalyst comprising nickel-molybdenum in the presence of essentially pure hydrogen, at a pressure ranging from about 400 psi to about 3000 psi, at a weight hourly space velocity ranging from about 0.25–4.5 and at a temperature ranging from about 550° F. to about 750° F. for a time sufficient to yield an improved lubricant base stock, which improved lubricant base stock exhibits an ASTM D-1500 color of about 2.5 or less after heating for 72 hours at 300° F.

10. The method of claim 9 wherein the sulfur content of said lubricating base stock is about 0.01 to 2.0 weight percent.

11. The method of claim 9 wherein said lubricating base stock comprises at least a substantial part of one obtained by fractionation of crude oil identified as West Texas, Brent or Olmeca.

12. The method of claim 9 wherein said catalyst is comprised of nickel and molybdenum on alumina.

13. A single stage catalytic method of improving the thermal stability of a lubricant base stock consisting essentially of solvent neutral oil, the method comprising:

contacting the solvent neutral oil lubricating base stock with a hydrofinishing catalyst comprising nickel-molybdenum in the presence of essentially pure hydrogen, at a pressure ranging from about 400 psi to about 3000 psi, at a weight hourly space velocity ranging from about 0.25–4.5 and at a temperature ranging from about 550° F. to about 650° F. for a time sufficient to yield an improved lubricant base stock, which improved lubricant base stock exhibits no observable precipitate after heating for 72 hours at 300° F.

14. The method of claim 13 wherein the sulfur content of said lubricating base stock is about 0.01 to 2.0 weight percent.

15. The method of claim 13 wherein said lubricating base stock comprises at least a substantial part of one obtained by fractionation of crude oil identified as West Texas, Brent or Olmeca.

16. The method of claim 13 wherein said catalyst is comprised of nickel and molybdenum on alumina.

* * * * *